US009897086B2

(12) United States Patent
Fujita et al.

(10) Patent No.: US 9,897,086 B2
(45) Date of Patent: Feb. 20, 2018

(54) VANE PUMP

(71) Applicant: KYB Corporation, Tokyo (JP)

(72) Inventors: Tomoyuki Fujita, Gifu (JP); Koichiro Akatsuka, Gifu (JP); Fumiyasu Kato, Aichi (JP); Hiroki Gomi, Gifu (JP)

(73) Assignee: KYB Corporation, Tokyo (JP)

( * ) Notice: Subject to any disclaimer, the term of this patent is extended or adjusted under 35 U.S.C. 154(b) by 77 days.

(21) Appl. No.: 15/111,188

(22) PCT Filed: Jan. 19, 2015

(86) PCT No.: PCT/JP2015/051269
§ 371 (c)(1),
(2) Date: Jul. 13, 2016

(87) PCT Pub. No.: WO2015/111550
PCT Pub. Date: Jul. 30, 2015

(65) Prior Publication Data

US 2016/0333876 A1 Nov. 17, 2016

(30) Foreign Application Priority Data

Jan. 27, 2014 (JP) ..... 2014-012054

(51) Int. Cl.
*F03C 2/00* (2006.01)
*F03C 4/00* (2006.01)
(Continued)

(52) U.S. Cl.
CPC ..... *F04C 15/06* (2013.01); *F04C 2/3446* (2013.01); *F04C 15/0049* (2013.01);
(Continued)

(58) Field of Classification Search
CPC ..... F04C 15/00; F04C 15/0049; F04C 15/06; F04C 2/3446; F04C 2210/206;
(Continued)

(56) References Cited

U.S. PATENT DOCUMENTS 3,781,145 A * 12/1973 Wilcox ..... F01C 21/0863 418/268
3,787,151 A 1/1974 Carlson
(Continued)

FOREIGN PATENT DOCUMENTS

JP 11-303773 A 11/1999
JP 2001-248569 A 9/2001
JP 2011-157954 8/2011

*Primary Examiner* — Theresa Trieu
(74) *Attorney, Agent, or Firm* — Rabin & Berdo, P.C.

(57) ABSTRACT

A vane pump used as a fluid pressure source includes: a rotor that is rotationally driven; a plurality of vanes that are inserted into the rotor in a freely slidable manner; a cam ring at which tip-end portions of the vanes slides as the rotor rotates; a pump chamber that is defined between the adjacent vanes; a suction port that guides working fluid to the pump chamber; a discharge port through which the working fluid discharged from the pump chamber is guided; a groove-like notch that extends from an opening edge of the discharge port in an opposite direction from rotation direction of the rotor, and the notch has a gradient-changing portion at which a rate of change of opening area is decreased in the rotation direction of the rotor.

4 Claims, 12 Drawing Sheets

(51) Int. Cl.

| | |
|---|---|
| ***F04C 2/00*** | (2006.01) |
| ***F04C 18/00*** | (2006.01) |
| ***F04C 15/06*** | (2006.01) |
| ***F04C 2/344*** | (2006.01) |
| ***F04C 15/00*** | (2006.01) |
| *F01C 21/08* | (2006.01) |

(52) U.S. Cl.
CPC .... *F01C 21/0863* (2013.01); *F04C 2210/206* (2013.01); *F04C 2240/20* (2013.01); *F04C 2250/102* (2013.01); *F04C 2250/30* (2013.01)

(58) Field of Classification Search
CPC ..... F04C 2240/20; F04C 2250/102; F04C 2250/30; F01C 21/0863; F01C 21/0809
USPC ..... 418/266–268, 259–260, 133, 77, 79–81
See application file for complete search history.

(56) References Cited

U.S. PATENT DOCUMENTS

| | | | | |
|---|---|---|---|---|
| 6,068,461 | A * | 5/2000 | Haga | F04C 21/0809 418/259 |
| 6,120,256 | A | 9/2000 | Miyazawa | |
| 6,203,303 | B1 * | 3/2001 | Fujiwara | F01C 21/0863 418/268 |
| 6,877,969 | B2 * | 4/2005 | Yao | F01C 21/0863 418/268 |
| 7,628,596 | B2 * | 12/2009 | Staton | F01C 21/0863 418/268 |
| 8,257,057 | B2 * | 9/2012 | Yamamuro | F04C 2/3442 418/133 |
| 2011/0165010 | A1 | 7/2011 | Iijima | |
| 2013/0052073 | A1 | 2/2013 | Ishihama et al. | |

* cited by examiner

VANE PUMP

TECHNICAL FIELD

The present invention relates to a vane pump that is used as a fluid pressure source.

BACKGROUND ART

A vane pump is used as a hydraulic source that supplies working oil to a hydraulic apparatus such as a transmission, a power steering apparatus, and so forth mounted on a vehicle.

JP2001-248569A discloses a vane pump including a plurality of pump chambers that are partitioned by a plurality of vanes between a cam ring and a rotor, suction ports that guide the working oil to the pump chambers undergoing an expansion stroke, discharge ports to which the working oil discharged from the pump chambers undergoing a compression stroke is guided, and groove-like notches that guide the working oil discharged from the pump chambers commencing an initial stage of the compression stroke to the discharge ports.

The above-mentioned groove-like notches extend in the opposite direction from the rotation direction of the rotor from opening edges of the discharge ports. The notches each has a shape in which a groove depth and an opening width gradually increase from its distal-end portion towards proximal-end portion and has a part at which a rate of change of the groove depth gradually increases from the distal-end portion towards the proximal-end portion.

SUMMARY OF INVENTION

However, with the above-mentioned notches, if lengths of the notches are set to be longer, the groove depths and the opening widths are increased at the proximal-end portions of the notches. Therefore, the proximal-end portions of the notches become larger than the space between the cam ring and the rotor. Thus, with the above-mentioned vane pump, because it is not possible to secure a sufficient notch length, there has been a problem in that, as described later, depending on an operating condition, pulsation of the discharge pressure of the working oil occurs.

An object of the present invention is to suppress the occurrence of the pulsation of the discharge pressure of a vane pump.

According to one aspect of the present invention, a vane pump used as a fluid pressure source includes: a rotor that is rotationally driven; a plurality of vanes that are inserted into the rotor in a freely slidable manner; a cam ring at which tip-end portions of the vanes slides as the rotor rotates; a pump chamber that is defined between the adjacent vanes; a suction port being configured to guide working fluid to the pump chamber; a discharge port through which the working fluid discharged from the pump chamber is configured to be guided; and a groove-like notch that extends from an opening edge of the discharge port in an opposite direction from rotation direction of the rotor, wherein the notch has a gradient-changing portion at which a rate of change of opening area is decreased in the rotation direction of the rotor.

DESCRIPTION OF EMBODIMENTS

First Embodiment

A first embodiment of the present invention will be described below with reference to the attached drawings.

Figure 1:
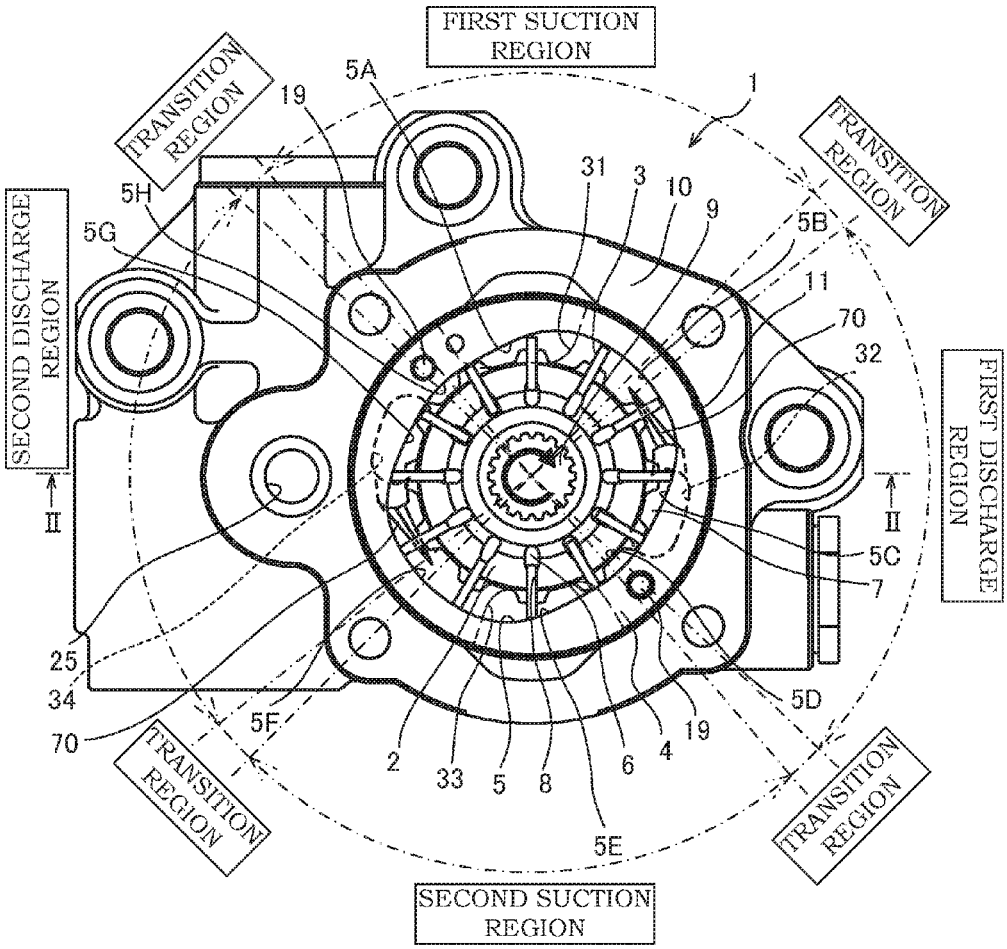
FIG. 1 is a front view of a vane pump according to a first embodiment of the present invention.
Figure 2:
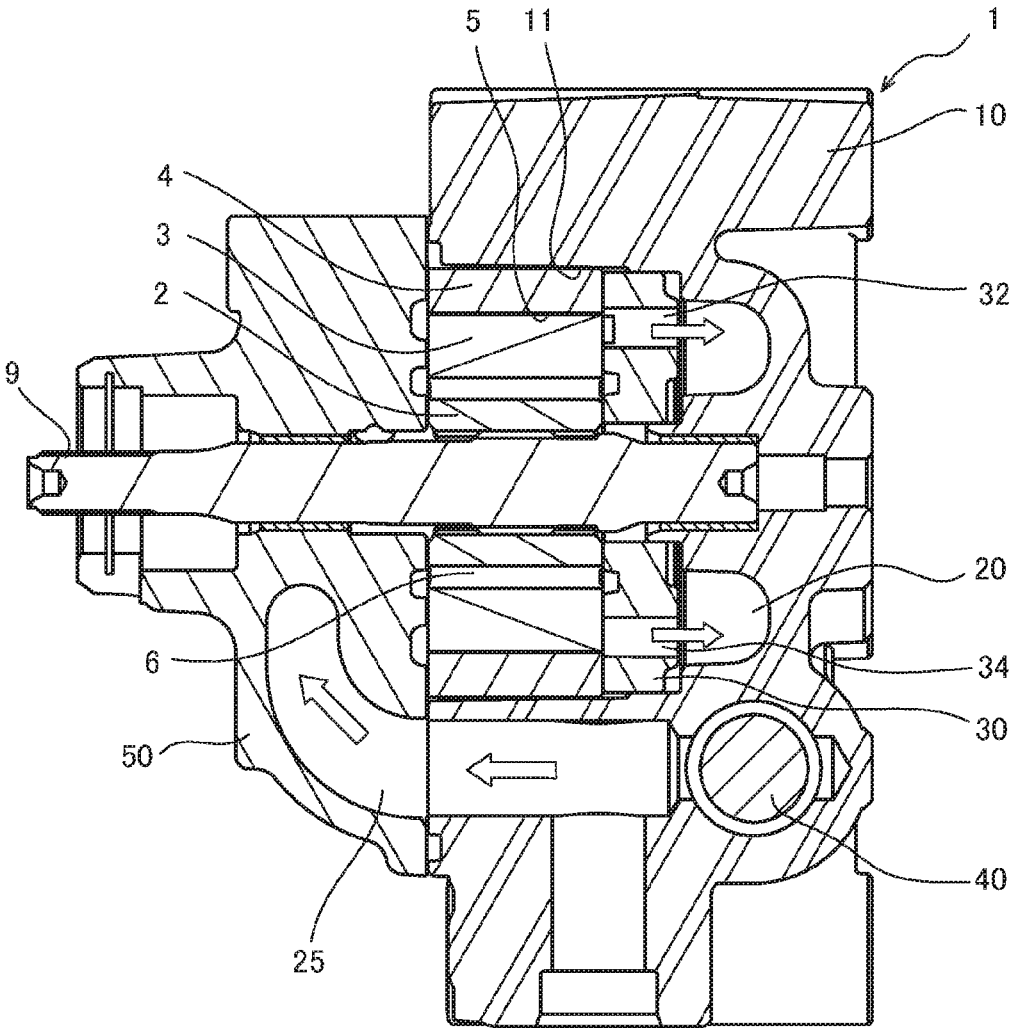
FIG. 2 is a sectional view taken along a line II-II in FIG. 1.

A vane pump 1 shown in FIGS. 1 and 2 is used as a fluid pressure source that supplies working fluid to a fluid pressure supply target. The fluid pressure supply target is, for example, a hydraulic apparatus that is of provided on a transmission, a power steering apparatus, or the like mounted on a vehicle. With the vane pump 1, working oil is used as the working fluid. With the vane pump 1, other non-compressive fluid may be used as the working fluid instead of the working oil.

The vane pump 1 includes a pump body 10 and a pump cover 50 as a casing. In the pump body 10, a pump accommodating concave portion 11 that is closed with the pump cover 50 is formed. In the pump accommodating concave portion 11, a rotor 2, vanes 3, a cam ring 4, a side plate 30, and so forth are accommodated as pumping mechanisms. Rotation of the cam ring 4 and the side plate 30 relative to the pump cover 50 is locked by two pins 19. The pump cover 50 is fastened to the pump body 10 by four bolts (not shown).

The vane pump 1 is not limited to the configuration mentioned above and may have a configuration in which the cam ring 4 and the side plate 30 are integrally formed with the pump body 10. In addition, a configuration in which a side plate separate from the pump cover 50 is provided in the vane pump 1 may be employed.

The rotor 2 is linked to a drive shaft 9. The drive shaft 9 is freely rotatably supported between the pump body 10 and the pump cover 50. Motive force from an engine or an electric motor (not shown) is transmitted to an end portion of the drive shaft 9. The rotor 2 is rotated in the direction indicated by an arrow shown in FIG. 1.

A plurality of vanes 3 are interposed between the cam ring 4 and the rotor 2. In the rotor 2, a plurality of slits 8 are formed in a radiating pattern at predetermined intervals. The vanes 3 are formed to have a rectangular plate shape and are inserted into the slits 8 in a freely slidable manner.

At back sides of the slits 8, vane back pressure chambers 6 are defined by proximal-end portions of the vanes 3. As described later, pump discharge pressure is guided to the vane back pressure chambers 6. The vanes 3 are biased in the directions in which the vanes 3 project out from the slits 8 by the pressure in the vane back pressure chambers 6 that pushes the proximal-end portions of the vanes 3 and by the centrifugal force that is caused by rotation of the rotor 2. Tip-end portions of the vanes 3 are thereby brought into sliding contact with an inner circumference cam face 5 of the cam ring 4.

A plurality of pump chambers 7 are defined in the cam ring 4 by the inner circumference cam face 5, the outer circumference of the rotor 2, and the adjacent vanes 3. As the rotor 2 is rotated, the vanes 3 that slide on the inner circumference cam face 5 are reciprocated to expand/contract the pump chambers 7. Thereby, as shown by arrows in FIG. 2, the working oil supplied from a tank is guided to suction ports 51 and 53 (see FIG. 3) and suction ports 31 and 33 (see FIG. 4) through a suction passage 25 and is sucked into the pump chambers 7. As shown by arrows in FIG. 2, the working oil that has been pressurized in the pump chambers 7 is discharged to high-pressure chambers 20 from discharge ports 32 and 34 and is supplied to a hydraulic apparatus through discharge passages (not shown) from the high-pressure chambers 20.

In the pump body 10, a flow control valve 40 is accommodated. A part of the working oil discharged from the pump chambers 7 to the discharge passage is returned by the flow control valve 40 as excessive oil to the pump chambers 7 through the suction passage 25. The flow amount of the working oil fed to the hydraulic apparatus is controlled by the operation of the flow control valve 40.

The annular cam ring 4 has the inner circumference cam face 5 having a substantially oval shape. As the rotor 2 completes a full rotation, respective vanes 3 following the inner circumference cam face 5 reciprocate twice.

The balanced vane pump 1 has a first suction region and a first discharge region in which the vanes 3 reciprocate for first time along with the rotation of the rotor 2 and a second suction region and a second discharge region in which the vanes 3 reciprocate for second time. In the first suction region, a first suction stroke in which the volumes of the pump chambers 7 are expanded is carried out. Subsequently, in the first discharge region, a first discharge stroke in which the volumes of the pump chambers 7 are contracted is carried out. Subsequently, in the second suction region, a second suction stroke in which the volumes of the pump chambers 7 are expanded is carried out. Subsequently, in the second discharge region, a second discharge stroke in which the volumes of the pump chambers 7 are contracted is carried out. Transition regions are respectively provided between the first suction region, the first discharge region, the second suction region, and the second discharge region.

In the inner circumference cam face 5 of the cam ring 4, a first suction section 5A in which the working oil is sucked through the first suction port 31 from the pump chambers 7 that are expanded during the first suction stroke, a transition section 5B provided in the transition region, a first discharge section 5C in which the working oil is discharged through the first discharge port 32 from the pump chambers 7 that are contracted during the first discharge stroke, a transition section 5D provided in the transition region, a second suction section 5E in which the working oil is sucked through the second suction port 33 from the pump chambers 7 that are expanded during the second suction stroke, a transition section 5F provided in the transition region, a second discharge section 5G in which the working oil is discharged through the second discharge port 34 from the pump chambers 7 that are contracted during the second discharge stroke, and a transition section 5H provided in the transition region are formed.

Figure 3:
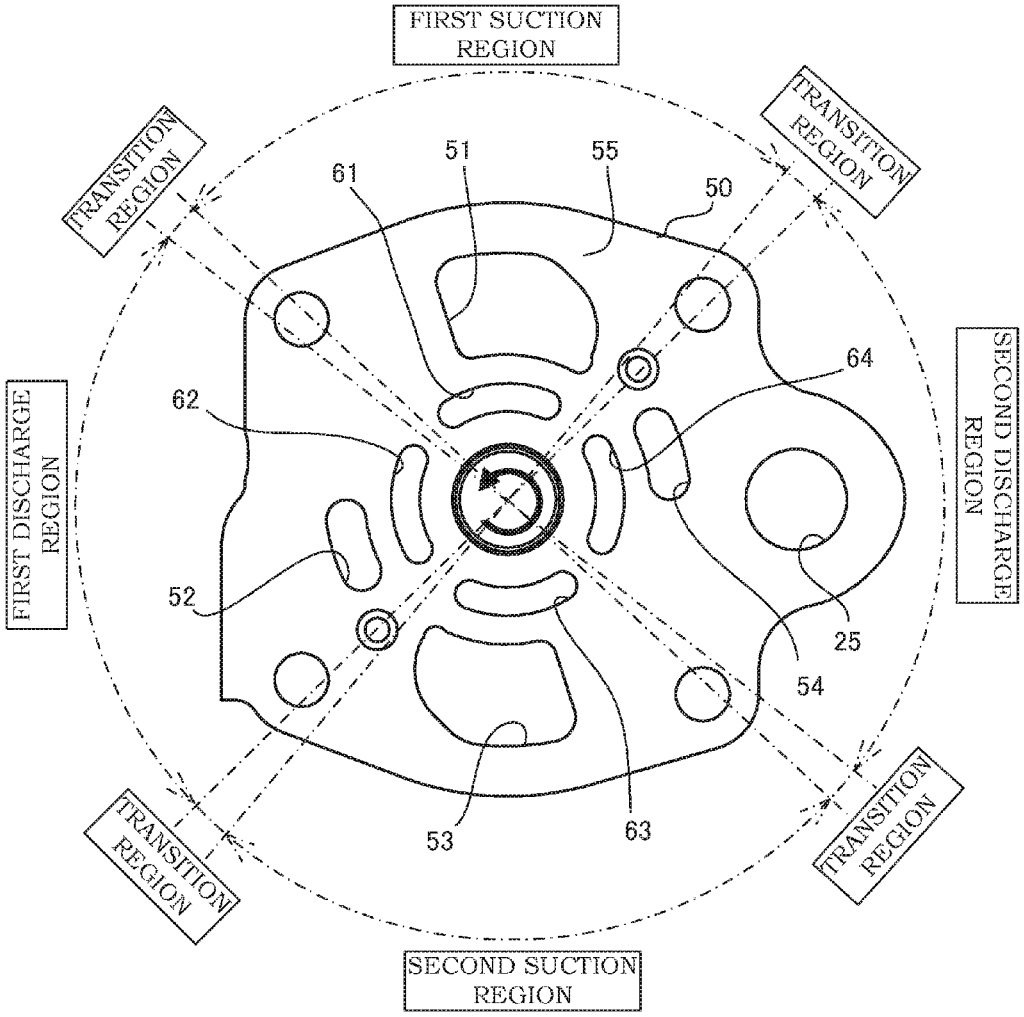
FIG. 3 is a rear view of a pump cover.

FIG. 3 is a rear view showing an end surface 55 of the pump cover 50 with which the rotor 2 comes in sliding contact. The rotor 2 rotates in the direction shown by an arrow in FIG. 3. On the end surface 55 of the pump cover 50, the suction port 51 and a back pressure port 61 open at the first suction region, a discharge port 52 and a back pressure port 62 open at the first discharge region, the suction port 53 and a back pressure port 63 open at the second suction region, and a discharge port 54 and a back pressure port 64 open at the second discharge region.

Figure 4:
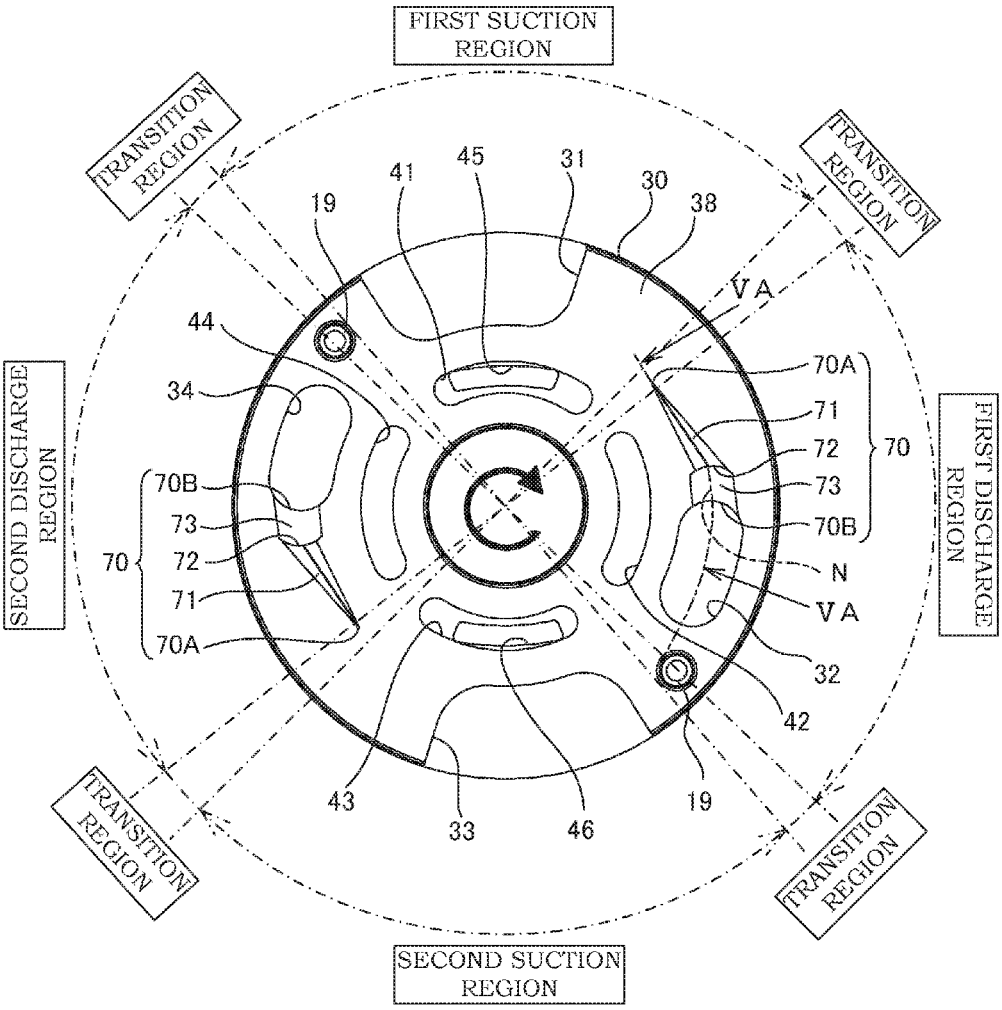
FIG. 4 is a front view of a side plate.

FIG. 4 is a front view showing an end surface 38 of the side plate 30 with which the rotor 2 comes in sliding contact. On the end surface 38, the suction port 31 and a back pressure port 41 open at the first suction region, the discharge port 32 and a back pressure port 42 open at the first discharge region, the suction port 33 and a back pressure port 43 open at the second suction region, and the discharge port 34 and a back pressure port 44 open at the second discharge region.

On the side plate 30, a discharge-pressure introducing hole 45 through which the high-pressure chambers 20 and the back pressure port 41 are communicated at the first suction region and a discharge-pressure introducing hole 46 through which the high-pressure chambers 20 and the back pressure port 43 are communicated at the second suction region are formed. With such a configuration, during operation of the vane pump 1, pump discharge pressure generated in the high-pressure chambers 20 is guided to the vane back pressure chambers 6 in the first and second suction regions through the back pressure ports 41 and 43.

In FIG. 4, the rotor 2 rotates in the direction shown by an arrow. Groove-like notches 70 open at the end surface 38 of the side plate 30 so as to extend from the opening edges of the discharge ports 32 and 34 in the opposite direction from the rotation direction of the rotor 2. Tip-end portions 70A of the notches 70 are arranged in first and second transition regions. The working oil is discharged to the first discharge port 32 through the notches 70 from the pump chambers 7 that contract in an initial stage and an intermediate stage of the first and second discharge strokes.

Figure 5A:
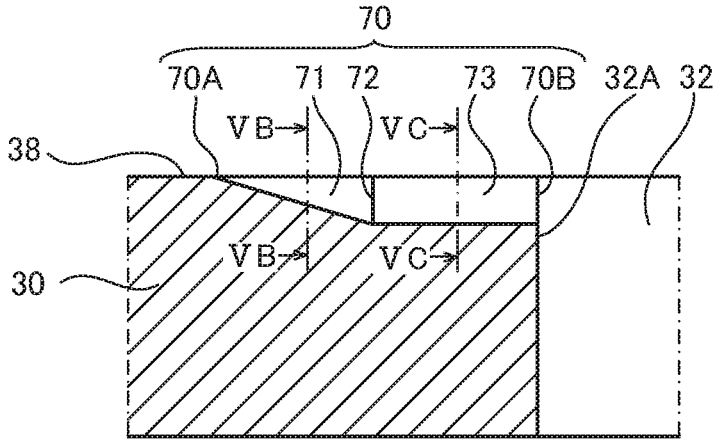
FIG. 5A is a sectional view of a notch of the side plate taken along a line VA-VA in FIG. 4.

FIG. 5A is a sectional view of the notch 70 taken along a line VA-VA in FIG. 4. As shown in this sectional view, the notch 70 has the distal-end portion 70A located at a distal position from the discharge port 32 and a proximal-end portion 70B that opens at an inner wall 32A of the discharge port 32. The notch 70 has an upstream groove portion 71 that extends from the distal-end portion 70A in the rotation direction of the rotor 2, a gradient-changing portion 72 that is provided at a downstream end of the upstream groove portion 71, and a downstream groove portion 73 that extends from the gradient-changing portion 72 in the rotation direction of the rotor 2. The gradient-changing portion 72 is a step which is formed between the upstream groove portion 71 and the downstream groove portion 73.

Figure 5B:
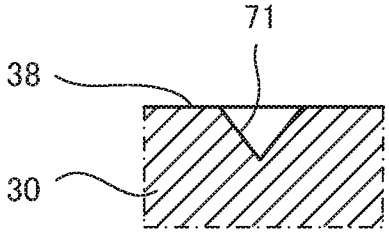
FIG. 5B is a sectional view taken along a line VB-VB in FIG. 5A.

FIG. 5B is a sectional view taken along a line VB-VB in FIG. 5A. As shown in this sectional view, the upstream groove portion 71 of the notch 70 has a triangular cross-sectional shape. The upstream groove portion 71 is formed to have a tapered shape in which the opening area of the notch 70 is gradually increased from the distal-end portions 70A in the rotation direction of the rotor 2 (in the direction approaching the gradient-changing portion 72). Note that the opening area of the notch 70 is the cross-sectional area of the notch 70 perpendicular to the center line N of the notch 70 (see FIG. 4).

Figure 5C:
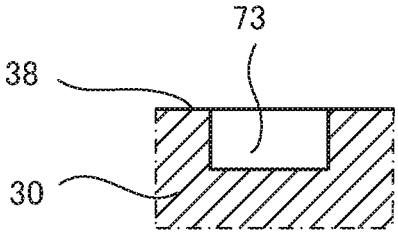
FIG. 5C is a sectional view taken along a line VC-VC in FIG. 5A.

FIG. 5C is a sectional view taken along a line VC-VC in FIG. 5A. As shown in this sectional view, the downstream groove portion 73 of the notch 70 has a rectangular cross-sectional shape. The downstream groove portion 73 is formed such that the opening area of the notch 70 remains unchanged and is kept constant from the upstream groove portion 71 in the rotation direction of the rotor 2 (in the direction approaching the discharge port 32).

Figure 6A:
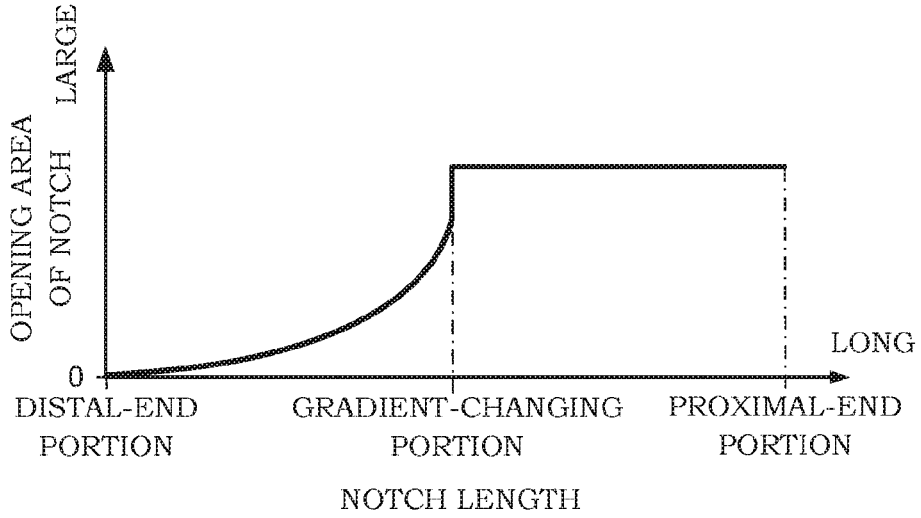
FIG. 6A is a line diagram showing a relationship between the notch length and the opening area.

FIG. 6A is a line diagram showing a relationship between the length of the notch 70 in the circumferential direction of the rotor 2 and the opening area of the notch 70. As shown in FIG. 6A, the opening area of the notch 70 is gradually increased from the distal-end portions 70A towards the gradient-changing portion 72 in the upstream groove portion 71, is increased in one step at the gradient-changing portion 72, and becomes a constant value at the downstream groove portion 73.

Figure 6B:
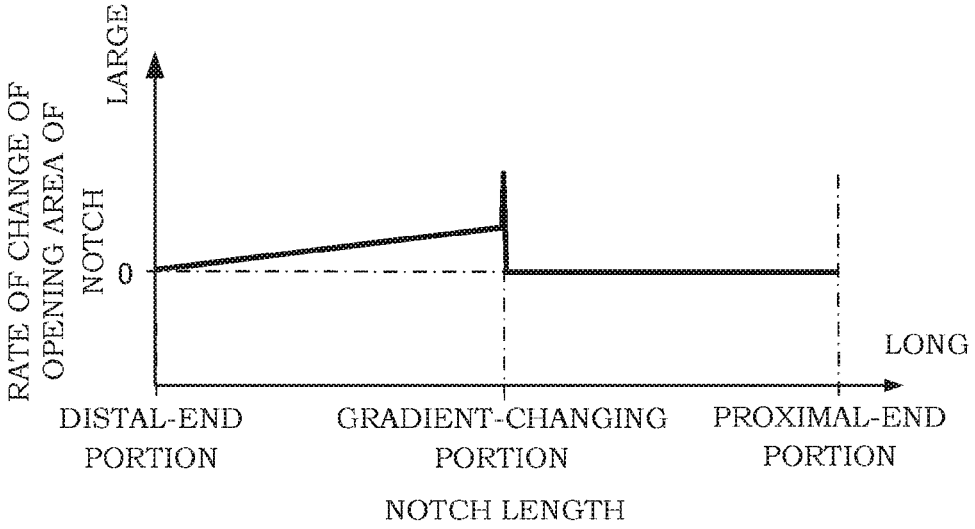
FIG. 6B is a line diagram showing a relationship between the notch length and the rate of change of the opening area.

FIG. 6B is a line diagram showing a relationship between the length of the notch 70 in the circumferential direction of the rotor 2 and the rate of change of the opening area of the notch 70. Note that the rate of change of the opening area of the notch 70 is a rate of change in the opening area of the notch 70 in the rotation direction of the rotor 2 relative to the length of the center line N of the notch 70 (see FIG. 4). As shown in FIG. 6B, the rate of change of the opening area of the notch 70 is gradually increased from the distal-end portions 70A towards the gradient-changing portion 72 in the upstream groove portion 71, is increased/decreased in one step at the gradient-changing portion 72, and becomes zero at the downstream groove portion 73. The gradient-changing portion 72 is a part at which the rate of change of the opening area of the notch 70 is discontinuously changed and decreased from the upstream groove portion 71 towards the downstream groove portion 73.

The gradient-changing portion 72 is not limited to the configuration mentioned above, and may be configured by curved surfaces with which the rate of change of the opening area of the notch 70 is continuously changed and decreased from the upstream groove portion 71 towards the downstream groove portion 73.

Next, an operation of the vane pump 1 will be described.

When the rotor 2 is rotated at low speed, the working oil that is discharged to the discharge port 32 through the notches 70 from the pump chambers 7 commencing the initial stage to the intermediate stage of a compression stroke and the working oil that is discharged to the discharge port 32 from the pump chambers 7 commencing a latter stage of the compression stroke are joined and discharged to the high-pressure chambers 20. With such a configuration, in the vane pump 1, the change in the working oil pressure from the pump chambers 7 to the discharge port 32 is made moderate through the notches 70, and it is possible to suppress the occurrence of vibration and noise.

On the other hand, when the rotor 2 is rotated at high speed, in a case where air is mixed into the working oil or a cavitation occurs, there is a delay in the pressure increase in the working oil pressurized in the pump chambers 7 commencing the initial stage of the compression stroke. Therefore, there is a possibility of the occurrence of a reverse-flow phenomenon in which the working oil that is discharged from the pump chambers 7 commencing the intermediate stage to the latter stage of the compression stroke abruptly flows through the notches 70 into the pump chambers 7 commencing the initial stage of the compression stroke.

Figure 7:
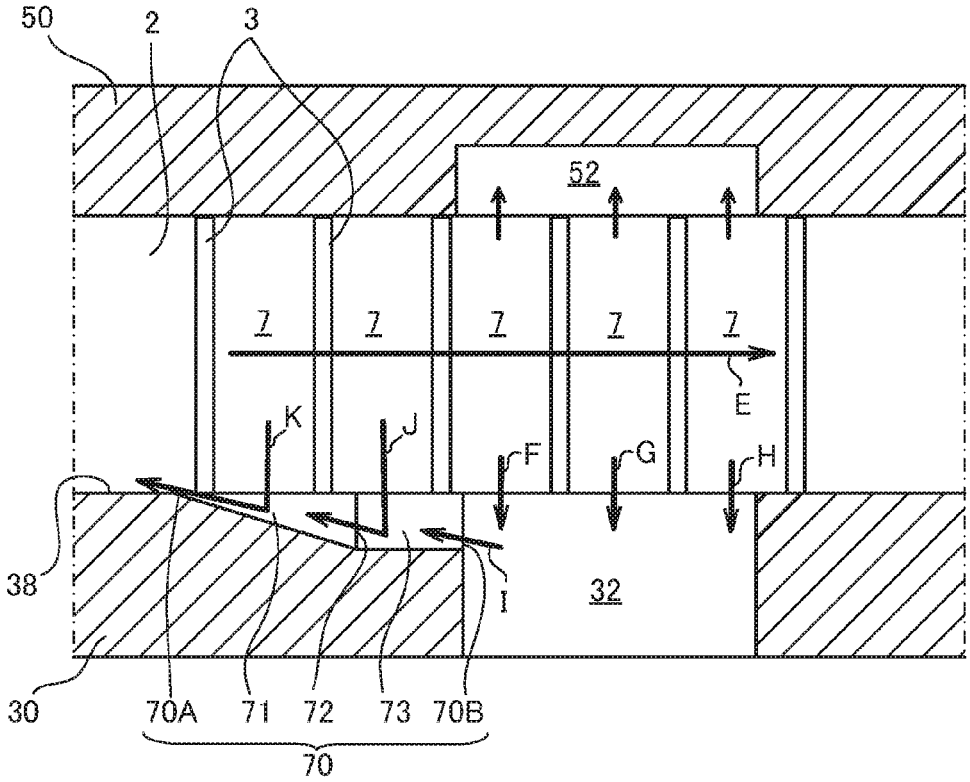
FIG. 7 is an exploded view of the notch, the discharge port, and so forth.

FIG. 7 is an exploded view showing by arrows a state in which the working oil flows into and flows out from the pump chambers 7 commencing the compression stroke, when the above-mentioned rotor 2 is rotated at high speed. In this exploded view, respective pump chambers 7 move in the direction shown by an arrow E. In the pump chambers 7 commencing the initial stage of the compression stroke, the air or vacuum portion contained in the working oil is compressed, and thereby, the pressure increase in the working oil is delayed. Therefore, as shown by arrows K and J, the working oil discharged from the pump chambers 7 commencing the intermediate stage of the compression stroke flows through the notches 70 into the pump chambers 7 commencing the initial stage of the compression stroke. By allowing the pressure of the working oil to propagate to each other between the pump chambers 7 facing against the notches 70 through the notches 70 in this way, the pressure increase in the pump chambers 7 commencing the initial stage of the compression stroke is facilitated. On the other hand, as shown by arrows F, G, and H, the working oil compressed in the pump chambers 7 commencing the latter stage of the compression stroke is discharged to the discharge port 32. By facilitating the pressure increase in the pump chambers 7 commencing the initial stage of the compression stroke through the notches 70, as shown by an arrow I, flow of the working oil that has been discharged to the discharge port 32 into the notches 70 is suppressed. By suppressing reverse flow of the working oil between the discharge port 32 and the notches 70 in this way, the occurrence of pulsation of discharge pressure at the discharge port 32 is suppressed.

Figure 8:
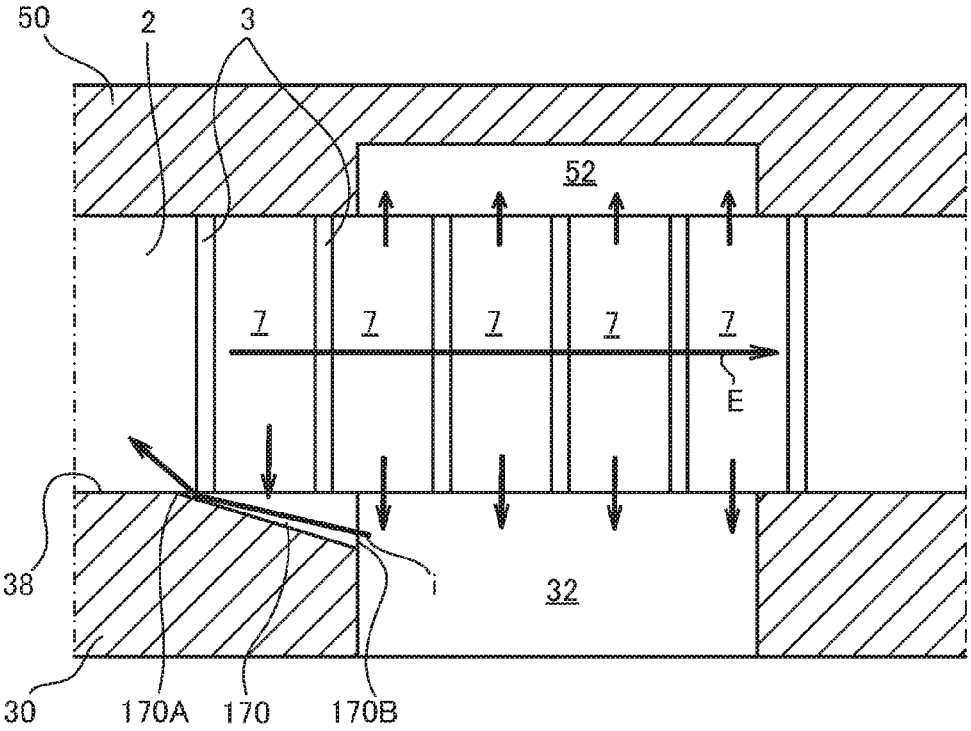
FIG. 8 is an exploded view of the notch, the discharge port, and so forth according to a comparative example.

FIG. 8 is an exploded view of a vane pump of a comparative example. With a notch 170 in this vane pump, the opening area is gradually increased from a distal end 170A to a proximal end 170B, and the rate of change of the opening area becomes a constant value or is gradually increased from the distal end 170A to the proximal end 170B. In this case, because the length of the notch 170 cannot be secured in the circumferential direction of the rotor 2, as shown by an arrow i, the reverse-flow phenomenon in which the working oil in the discharge port 32 abruptly flows into the pump chambers 7 commencing the initial stage of the compression stroke through the notch 170 occurs, thereby causing the pulsation of the discharge pressure at the discharge port 32.

According to the above-mentioned first embodiment, operational advantages shown below can be afforded.

[1] The vane pump 1 including the groove-like the notches 70 that extend from the opening edges of the discharge ports 32 and 34 in the opposite direction from the rotation direction of the rotor 2 is configured so as to have parts (the gradient-changing portions 72) at which the rate of change of the opening area of the notches 70 is decreased in the rotation direction of the rotor 2.

With the vane pump 1, because the gradient-changing portions 72 at which the rate of change of the opening area of the notches 70 is decreased towards the discharge ports 32 and 34 are provided, it is possible to set the lengths of the notches 70 to be longer while suppressing the increase in the opening width of the notches 70 with the increase in the lengths of the notches 70.

By sufficiently securing the lengths of the notches 70 in the circumferential direction of the rotor 2, it is possible to set the lengths of the notches 70 such that the plurality of pump chambers 7 commencing the compression stroke communicate with the notches 70. With such a configuration, the pressure of the working oil is propagated to each other between the plurality of pump chambers 7 arranged along the circumferential direction of the rotor 2 through the notches 70, the reverse-flow phenomenon in which the working oil that has been discharged from the pump chambers 7 to the discharge ports 32 and 34 abruptly flows through the notches 70 into the pump chambers 7 commencing the initial stage of the compression stroke is suppressed, and the occurrence of the pulsation the discharge pressure at the discharge ports 32 and 34 is suppressed.

[2] The notches 70 are configured so as to have the upstream groove portion 71 at which the opening area is gradually increased from the distal-end portions 70A in the rotation direction of the rotor 2 and the downstream groove portion 73 at which the opening area of the notches 70 remains the same from the upstream groove portion 71 in the rotation direction of the rotor 2.

According to the above-mentioned configuration, because the downstream groove portions 73 that have the constant opening area are provided, the opening areas of the notches 70 are sufficiently secured, and at the same time, the lengths of the notches 70 in the circumferential direction of the rotor 2 are sufficiently secured. With such a configuration, suppression of the reverse-flow phenomenon in which the working oil abruptly flows into the pump chambers 7 through the notches 70 from the discharge ports 32 and 34 when the rotor 2 is rotated at high speed and smooth introduction of the flow of the working oil from the pump chambers 7 to the discharge ports 32 and 34 through the notches 70 when the rotor 2 is rotated at low speed can both be achieved.

[3] The notches 70 are configured such that the opening areas at the discharge ports 32 and 34 sides of the gradient-changing portions 72 are larger than the opening areas at the distal-end portions 70A sides of the gradient-changing portions 72.

According to the above-mentioned configuration, when the rotor 2 is rotated at high speed, the abrupt flow of the working oil from the discharge ports 32 and 34 through the notches 70 to the pump chambers 7 is restricted at the gradient-changing portions 72, and so, the reverse-flow phenomenon of the working oil in the notches 70 is effectively suppressed.

Second Embodiment

Next, a second embodiment of the present invention will be described with reference to FIGS. 9A to 9C, 10A, and 10B. In the following, differences from the above-mentioned first embodiment will be mainly described, and components that are the same as those in the above-mentioned first embodiment are assigned the same reference numerals and descriptions thereof will be omitted.

The notch 70 according to the above-mentioned first embodiment is configured so as to have the downstream groove portion 73 in which the opening area of the notches 70 is set to be constant. In contrast, a notch 80 according to the second embodiment is configured such that the opening area of the notch 80 is gradually decreased in the rotation direction of the rotor 2.

Figure 9A:
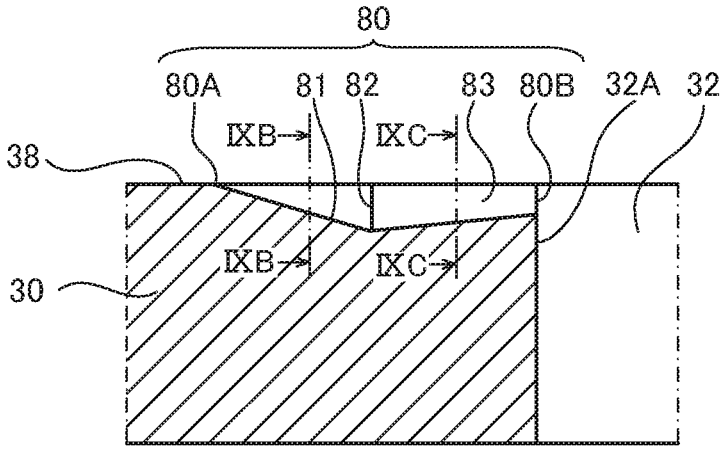
FIG. 9A is a sectional view of the notch according to a second embodiment of the present invention.

As shown in FIG. 9A, the notch 80 has a distal-end portion 80A located at a distal position from the discharge port 32 and a proximal-end portion 80B that opens at the inner wall 32A of the discharge port 32. The notch 80 has an upstream groove portion 81 that extends from the distal-end portion 80A in the rotation direction of the rotor 2, a gradient-changing portion 82 that is provided at a downstream end of the upstream groove portion 81, and a downstream groove portion 83 that extends from the gradient-changing portion 82 in the rotation direction of the rotor 2. The gradient-changing portion 82 is a step which is formed between the upstream groove portion 81 and the downstream groove portion 83.

Figure 9B:
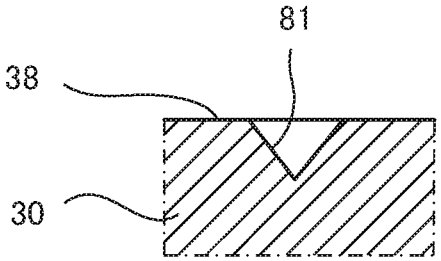
FIG. 9B is a sectional view taken along a line IXB-IXB in FIG. 9A.

FIG. 9B is a sectional view taken along a line IXB-IXB in FIG. 9A. As shown in this sectional view, the upstream groove portion 81 of the notch 80 has a triangular cross-sectional shape. The upstream groove portion 81 is formed such that the opening area of the notch 80 is gradually increased from the distal-end portion 80A in the rotation direction of the rotor 2 (in the direction approaching the gradient-changing portion 82).

Figure 9C:
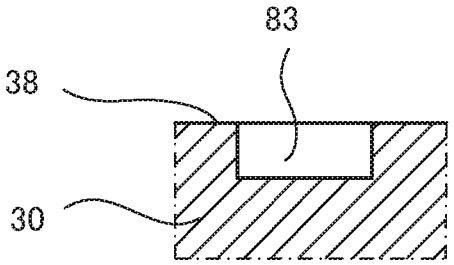
FIG. 9C is a sectional view taken along a line IXC-IXC in FIG. 9A.

FIG. 9C is a sectional view taken along a line IXC-IXC in FIG. 9A. As shown in this sectional view, the downstream groove portion 83 of the notch 80 has a rectangular cross-sectional shape. The downstream groove portion 83 is formed such that the opening area of the notch 80 is gradually decreased from the upstream groove portion 81 in the rotation direction of the rotor 2 (in the direction approaching the discharge port 32).

Figure 10A:
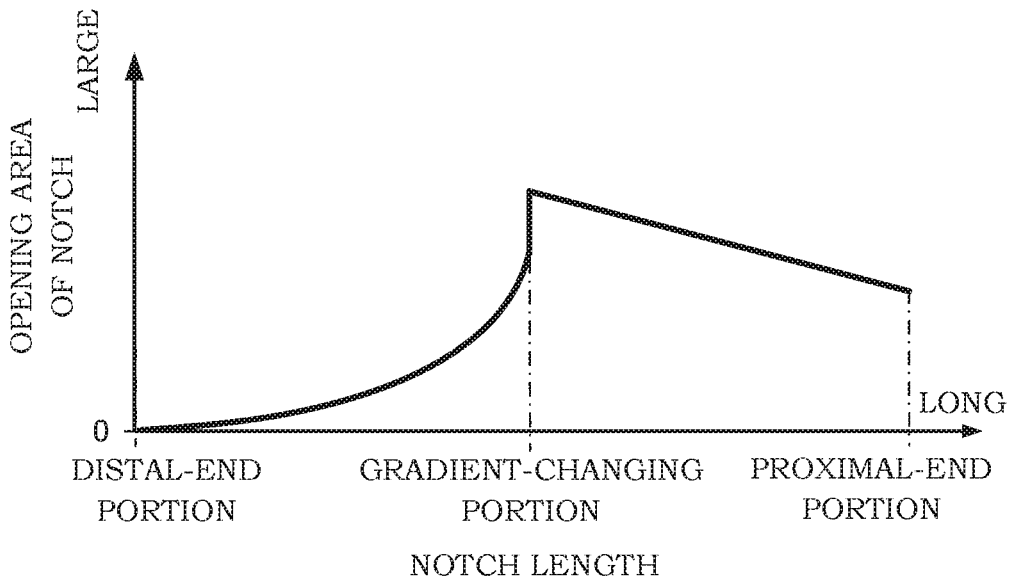
FIG. 10A is a line diagram showing a relationship between the notch length and the opening area.

FIG. 10A is a line diagram showing a relationship between the length of the notch 80 in the circumferential direction of the rotor 2 and the opening area of the notch 80. As shown in this line diagram, the opening area of the notch 80 is gradually increased from the distal-end portion 80A towards the gradient-changing portion 82 at the upstream groove portion 81, is increased in one step at the gradient-changing portion 82, and is gradually decreased from the gradient-changing portion 82 towards the proximal-end portion 80B at the downstream groove portion 83.

Figure 10B:
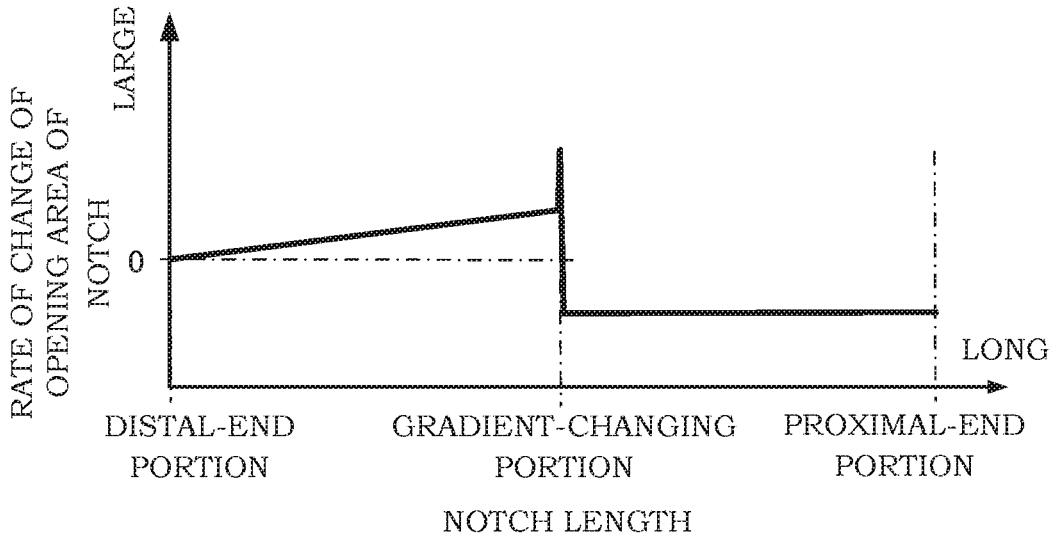
FIG. 10B is a line diagram showing a relationship between the notch length and the rate of change of the opening area.

FIG. 10B is a line diagram showing a relationship between the length of the notch 80 in the circumferential direction of the rotor 2 and the rate of change of the opening area of the notch 80. As shown in this line diagram, the rate of change of the opening area of the notch 80 is gradually increased from the distal-end portion 80A towards the gradient-changing portion 82 at the upstream groove portion 81, is increased/decreased in one step at the gradient-changing portion 82, and becomes a negative constant value at the downstream groove portion 83. The gradient-changing portion 82 is a part at which the rate of change of the opening area of the notch 80 is discontinuously changed and decreased from the upstream groove portion 81 towards the downstream groove portion 83.

The gradient-changing portion 82 is not limited to the configuration mentioned above, and may be configured by curved surfaces with which the rate of change of the opening area of the notch 80 is continuously changed and decreased from the upstream groove portion 81 towards the downstream groove portion 83.

According to the above-mentioned second embodiment, operational advantages shown below can be afforded.

[4] The notch 80 has the upstream groove portion 81 at which the opening area of the notch 80 is gradually increased from the distal-end portion 80A in the rotation direction of the rotor 2 and the downstream groove portion 83 at which the opening area of the notch 80 is gradually decreased from the upstream groove portion 81 in the rotation direction of the rotor 2.

According to the above-mentioned configuration, with the downstream groove portion 83 whose opening area is gradually decreased, the flow of the working oil from the pump chambers 7 commencing the intermediate stage of the compression stroke to the pump chambers 7 commencing the initial stage of the compression stroke is facilitated, and at the same time, the flow of the working oil from the discharge ports 32 and 34 commencing the latter stage of the compression stroke to the notch 80 is suppressed. The propagation of the pressure of the working oil through the notch 80 between the pump chambers 7 facing against the notch 80 is facilitated in this way, and thus, when the rotor 2 is rotated at high speed, the occurrence of the pulsation of the discharge pressure at the discharge ports 32 and 34 is suppressed.

Third Embodiment

Next, a third embodiment of the present invention will be described with reference to FIGS. 11A to 11D, 12A, and 12B. In the following, differences from the above-mentioned first embodiment will be mainly described, and components that are the same as those in the above-mentioned first embodiment are assigned the same reference numerals and descriptions thereof will be omitted.

A notch 90 according to the third embodiment is configured so as to have a restrictor portion 95 provided at the discharge port 32 such that the opening area of the notch 90 is locally decreased.

Figure 11A:
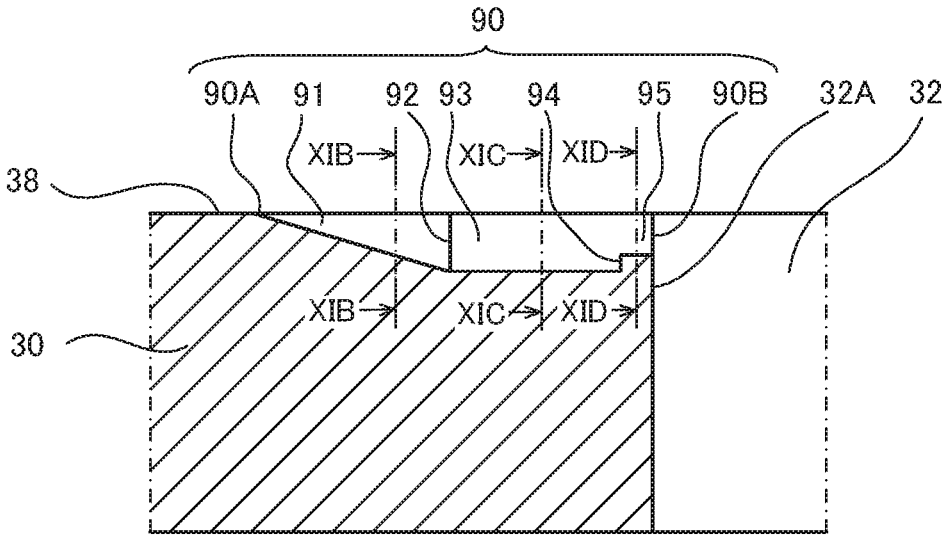
FIG. 11A is a sectional view of the notch according to a third embodiment of the present invention.

As shown in FIG. 11A, the notch 90 has a distal-end portion 90A located at a distal position from the discharge port 32 and a proximal-end portion 90B that opens at the inner wall 32A of the discharge port 32. The notch 90 has an upstream groove portion 91 that extends from the distal-end portion 90A in the rotation direction of the rotor 2, a gradient-changing portion 92 that is provided at a downstream end of the upstream groove portion 91, a downstream groove portion 93 that extends from the gradient-changing portion 92 in the rotation direction of the rotor 2, a step portion 94 that is provided at a downstream end of the downstream groove portion 93, and the restrictor portion 95 provided at the discharge port 32 such that the opening area of the notch 90 is locally decreased. The gradient-changing portion 92 is a step which is formed between the upstream groove portion 91 and the downstream groove portion 93. The step portion 94 is a step which is formed between the downstream groove portion 93 and the restrictor portion 95.

Figure 11B:
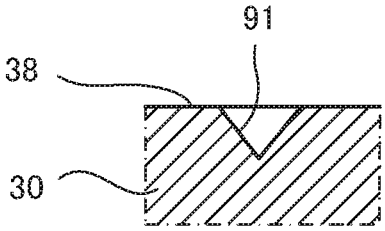
FIG. 11B is a sectional view taken along a line XIB-XIB in FIG. 11A.

FIG. 11B is a sectional view taken along a line XIB-XIB in FIG. 11A. As shown in this sectional view, the upstream groove portion 91 of the notch 90 has a triangular cross-sectional shape. The upstream groove portion 91 is formed such that the opening area of the notch 90 is gradually increased from the distal-end portion 90A in the rotation direction of the rotor 2 (in the direction approaching the gradient-changing portion 92).

Figure 11C:
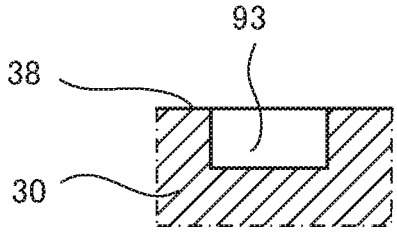
FIG. 11C is a sectional view taken along a line XIC-XIC in FIG. 11A.

FIG. 11C is a sectional view taken along a line XIC-XIC in FIG. 11A. As shown in this sectional view, the downstream groove portion 93 of the notch 90 has a rectangular cross-sectional shape. The downstream groove portion 93 is formed such that the opening area of the notch 90 remains unchanged and is kept constant from the upstream groove portion 91 in the rotation direction of the rotor 2 (in the direction approaching the discharge port 32).

Figure 11D:
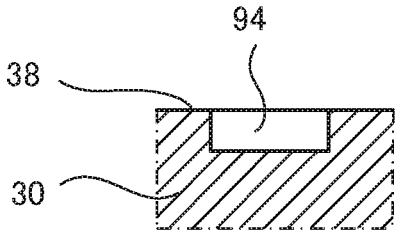
FIG. 11D is a sectional view taken along a line XID-XID in FIG. 11A.

FIG. 11D is a sectional view taken along a line XID-XID in FIG. 11A. As shown in this sectional view, the restrictor portion 95 of the notch 90 has a rectangular cross-sectional shape that is smaller than the downstream groove portion 93. The restrictor portion 95 is formed such that the opening area of the notch 90 remains unchanged and is kept constant from the downstream groove portion 93 in the rotation direction of the rotor 2 (in the direction approaching the discharge port 32).

Figure 12A:
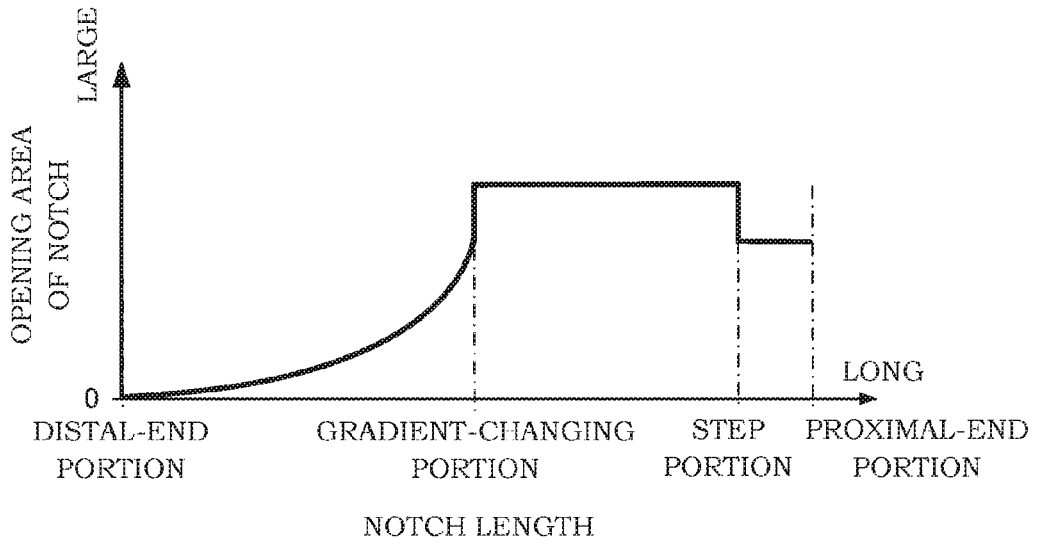
FIG. 12A is a line diagram showing a relationship between the notch length and the opening area.

FIG. 12A is a line diagram showing a relationship between the length in the circumferential direction of the rotor 2 and the opening area in the notch 90. As shown in this line diagram, the opening area of the notch 90 is gradually increased from the distal-end portion 90A towards the gradient-changing portion 92 at the upstream groove portion 91, is increased in one step at the gradient-changing portion 92, becomes a constant value at the downstream groove portion 93, is decreased in one step at the step portion 94, and becomes a constant value at the restrictor portion 95.

Figure 12B:
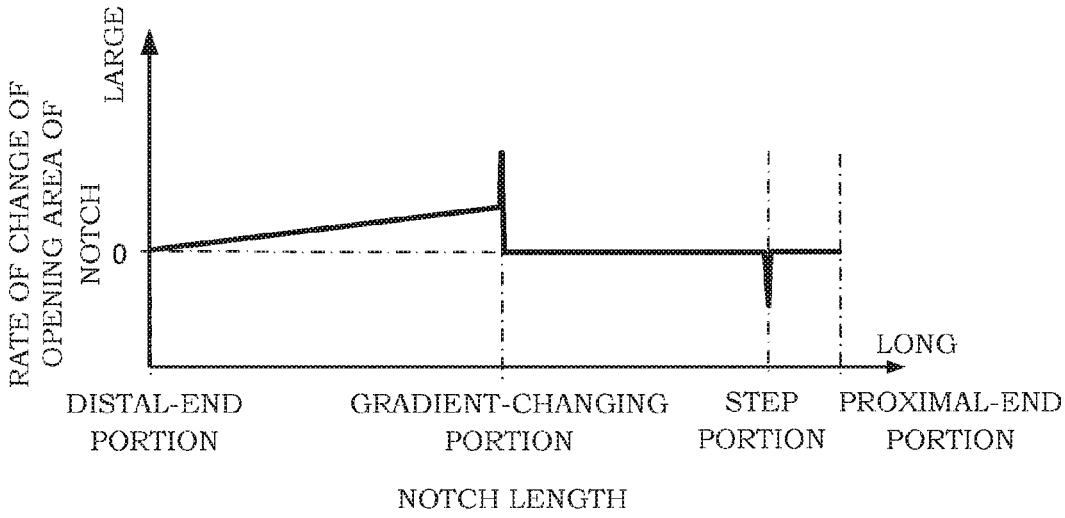
FIG. 12B is a line diagram showing a relationship between the notch length and the rate of change of the opening area.

FIG. 12B is a line diagram showing a relationship between the length in the circumferential direction of the rotor 2 and the rate of change of the opening area in the notch 90. As shown in this line diagram, the rate of change of the opening area of the notch 90 is gradually increased from the distal-end portion 90A towards the gradient-changing portion 92 at the upstream groove portion 91, is increased/decreased in one step at the gradient-changing portion 92, becomes zero at the downstream groove portion 93, is increased/decreased in one step at the step portion 94, and becomes zero at the restrictor portion 95. The gradient-changing portion 92 is a part at which the rate of change of the opening area of the notch 90 is discontinuously changed and decreased.

The gradient-changing portion 92 and the step portion 94 are not limited to the configuration mentioned above, and may be configured by curved surfaces with which the rate of change of the opening area of the notch 90 is continuously changed.

According to the above-mentioned third embodiment, operational advantages shown below can be afforded.

[5] The notch 90 has the restrictor portion 95 provided at the discharge port 32 such that the opening area of the notch 90 is locally decreased.

According to the above-mentioned configuration, with the restrictor portion 95 with which the opening area is locally decreased, the flow of the working oil from the discharge ports 32 and 34 commencing the latter stage of the compression stroke to the notch 90 is suppressed. With such a configuration, when the rotor 2 is rotated at high speed, the occurrence of the pulsation of the discharge pressure at the discharge ports 32 and 34 is suppressed.

Embodiments of this invention were described above, but the above embodiments are merely examples of applications of this invention, and the technical scope of this invention is not limited to the specific constitutions of the above embodiments.

For example, although the notch according to the above-mentioned embodiments has a downstream groove portion at which the opening area is kept constant or decreased, the configuration is not limited thereto, and a configuration in which the notch has a downstream groove portion at which the opening area is gradually increased, and the rate of change of the opening area of this downstream groove portion is smaller than the rate of change of the opening area of the upstream groove portion may be employed.

In addition, the present invention may be applied not only to the vane pump in which the discharge capacity (pump displacement) is constant, but to the vane pump in which the discharge capacity can be changed by moving the cam ring.

This application claims priority based on Japanese Patent Application No. 2014-12054 filed with the Japan Patent Office on Jan. 27, 2014, the entire contents of which are incorporated into this specification.

The invention claimed is:

1. A vane pump used as a fluid pressure source comprising:

a rotor that is rotationally driven;

a plurality of vanes that are inserted into the rotor in a freely slidable manner;

a cam ring at which tip-end portions of the vanes slides as the rotor rotates;

a pump chamber that is defined between the adjacent vanes;

a suction port that guides working fluid to the pump chamber;

a discharge port through which the working fluid discharged from the pump chamber is guided; and a groove-like notch that extends from an opening edge of the discharge port in an opposite direction from rotation direction of the rotor, wherein the notch has a gradient-changing portion at which a rate of change of opening area is decreased in the rotation direction of the rotor, and the opening area of the notch is increased in one step in the rotation direction of the rotor at the gradient-changing portion.

2. The vane pump according to claim 1, wherein the notch has:

an upstream groove portion at which the opening area is gradually increased from a distal-end portion in the rotation direction of the rotor; and a downstream groove portion at which the opening area remains unchanged from the upstream groove portion in the rotation direction of the rotor.

3. The vane pump according to claim 1, wherein the notch has:

an upstream groove portion at which the opening area is gradually increased from a distal-end portion in the rotation direction of the rotor; and a downstream groove portion at which the opening area is gradually decreased from the upstream groove portion in the rotation direction of the rotor.

4. The vane pump according to claim 1, wherein the notch has a restrictor portion provided at the discharge port such that the opening area is locally decreased.

* * * * *